US006394198B1

(12) United States Patent
Hall et al.

(10) Patent No.: US 6,394,198 B1
(45) Date of Patent: May 28, 2002

(54) FRICTIONAL VIBRATION DAMPER FOR DOWNHOLE TOOLS

(76) Inventors: David R. Hall; Joe Fox, both of 2185 S. Larsen Pkwy., Provo, UT (US) 84606

( * ) Notice: Subject to any disclaimer, the term of this patent is extended or adjusted under 35 U.S.C. 154(b) by 0 days.

(21) Appl. No.: 09/603,984

(22) Filed: Jun. 26, 2000

(51) Int. Cl.[7] ..... E21B 10/44

(52) U.S. Cl. ..... 175/323; 175/325.3; 175/377; 175/431

(58) Field of Search ..... 175/320, 323, 175/325.1, 325.3, 326, 327, 374, 377, 385, 426, 428, 431, 434

(56) References Cited

U.S. PATENT DOCUMENTS 3,306,381 A * 2/1967 Garrett et al.
4,709,462 A * 12/1987 Perkin et al.
5,332,051 A * 7/1994 Knowlton

* cited by examiner

*Primary Examiner*—Roger Schoeppel

(57) ABSTRACT

A damper for downhole tools consisting of a plurality of damping inserts arrayed about the tool body so that their radial protrusion describes a circumference greater than desired gauge of the borehole. The damper inserts are configured with rounded working surfaces that radially protrude from the tool body and are coated with an abrasion resistant, superhard material. The damper inserts are progressively arrayed so that they are constantly forced against the walls of the borehole. In this manner, they may plastically fail the formation by an indenting, brinelling, or crushing action that produces a constant torsional load on the downhole tools, and controls the torsional unloading of the downhole tools and absorbs the vibrations of the drilling tool as the formation is being drilled.

10 Claims, 6 Drawing Sheets

FRICTIONAL VIBRATION DAMPER FOR DOWNHOLE TOOLS

RELATED APPLICATIONS

None.

BACKGROUND OF THE INVENTION

This invention relates to a frictional vibration damper for use in connection with drill pipes, drill pipe sub assemblies, drill collars, bottom hole assemblies, and drill bits for drilling through subterranean formations. More particularly, this invention describes a vibration damper for downhole tools, particularly drill bits, that will protect cutting inserts and other components from damage due to axial and radial vibrations. These potentially damaging vibrations are produced by drill string flex and high torsional loading and uncontrolled unloading of downhole tools incident to drilling deep oil, gas, and geothermal wells.

Downhole tools such as the drill string which is made of drill pipe, subs, drill collars, bottom hole assemblies, and drill bits, collectively referred to as downhole tools in this application, produce strong vibrations during the drilling process. Excessive vibrations in one tool may adversely affect the performance of other tools as well as the entire drill string.

The dynamics of drilling deep wells are very complex and are affected in large part by the length of the drill string. The length of a drill string used in oil, gas, and geothermal well formation may total as much as 20,000 feet, or more, and is made up of coiled tubing or discrete lengths of drill pipe, drill collars, drill bits, and other downhole tools that are interconnected by tool joints. Each drill pipe is approximately 30 feet in length. Other downhole tools such as drill collars, sub and bottom-hole assemblies, fluid driven hammers, and mud motors vary in length from just a few feet to lengths similar to those of the drill pipe. A drill string weighs according to its length and diameter 100,000 pounds or more and is suspended from the surface by the drill rig. The weight of the drill string is used to drive the downhole tools forward during the drilling operation. This force is generally known as "weight on bit" and is controlled at the drill rig by constantly pulling up on the drill string. During drilling, the downhole tools are rotated at a rate of between 60 and 120 RPM, either by a high torque turntable on the floor of the drill rig or by a downhole hydraulic motor, known as a mud motor. Drilling fluid is pumped down the bore of the drill string and exhausted at the drill bit. As the drill bit penetrates the formation, it forms a borehole of a predetermined diameter, or gauge, which is larger than the circumference of the components of the drill string. The area differential between the gauge of the borehole and the circumference of the drill string is known as the annulus, and it provides a path for drilling fluid to return to the surface carrying the cuttings and other debris produced by the drill bit. A suspended drill string is constantly under tension and becomes very flexible behaving much like a spring during the drilling operation. Even though the weight on bit may be several thousand pounds, the drill string may flex longitudinally causing the bit to actually bounce on the bottom of the borehole. The friction along the surface of the drill string caused by the circulating drilling fluid, and the friction from downhole tools rubbing against the wall of borehole, when combined with the natural resistance of the formation to the cutting action of the drill bit, produces a high torsional load in the downhole tools. This load may actually cause the drill string to wind up like a spring. (If weight on bit and torque are not carefully controlled, the torsional load on the drill string will actually "twist off" the drill pipe.) As torque is constantly applied to the down hole tools, the torsional load builds up until the stored energy overcomes the resistance of the downhole tools, and they break loose accelerating to over 300 rpm. For this reason it has been observed that the rate of rotation of the drill string at the surface is not representative of the rate of rotation of the down hole tools at the bottom of the borehole. Because of the flexibility of the drill string, during periods of acceleration, the drill string and downhole tools actually radially and axially bounce, or vibrate, until the stored energy in the drill string dissipates, and the dynamic cycle of loading and unloading begins again. An analogy may be drawn to a capacitor and a resistor in an electronic circuit. The downhole tools, especially the drill bit, store torsional energy that will discharge violently unless controlled by a resistor.

Therefore, unless the stored torsional load in the downhole tools is damped, a violent discharge of energy will occur, manifesting itself as excessive vibrations causes excessive wear and damage to the downhole tools and may also result in borehole deviation. Therefore, it is desirable to develop means for damping vibrations by controlling the torsional loading and unloading in downhole tools.

One means that has been developed is described in U.S. Pat. No. 3,660,990, incorporated herein. This patent teaches the use of a sub assembly having a metallic sleeve slidably housed in splines within the casing. A rubber bush is provided so that when the drill bit receives a longitudinal shock the sleeve moves into the casing assembly and the rubber bush is deformed to absorb the shock. This tool is axisymmetric with the drill string within the borehole. It is not intended to ride on or rub against the walls of the borehole.

Vibrations in downhole tools result from complex forces acting on the tools simultaneously. These vibrations consist of axial, radial, and torsional movements all along the drill string. The preceding patent does not treat in full the complexity of tool vibrations and is limited to damping the longitudinal movement of the drill bit. Also, the mechanism restricts the flow of drilling fluid, requiring higher horsepower uphole and adds a complex, expensive component to the drill string that is prone to failure in the harsh environment downhole due to the invasive nature of abrasive drilling fluids pressurized to 10,000 psi downhole.

Another frictional damper in drilling tools is taught in U.S. Pat. No. 4,428,443, incorporated herein by this reference. Therein is disclosed a shock-absorbing tool having a number of open sections formed in a cylindrical member. The open sections are connected by a plurality of slots. As dynamic axial and torsional loads are applied to the drill string, the tool absorbs these loads through deflection of the tool such that the slots close and the stress is carried about the periphery of the open sections. This tool is deployed axisymmetrically with the drill string and is not intended to rub against the walls of the borehole. In fact, interference with the walls of the borehole would compromise the usefulness of this shock-absorbing tool.

Another frictional damper in drilling tools is taught in U.S. Pat. No. 4,901,806, incorporated herein. In this patent, a sub assembly is taught for positioning in the drill string above the bit. The mechanism provides for rotational torque to be transferred to the drill by a series of helical splines. Dual pistons with corresponding fluid chambers dampen axial forces while the helical splines decouple the torsional forces from axial vibrations to insure proper control of the drill bit. Like the previous frictional dampers, this tool is not intended to rub or ride on the borehole wall.

Another means for controlling bit vibrations is displayed in U.S. Pat. No. 5,755,297, incorporated herein. In this disclosure, lugs or pads are preinstalled in the arms of a roller cone bit as an aid to stabilize the bit. The outside dimensions of the stabilizer pad are substantially equal to, or less than, the desired radius for the borehole. This disclosure teaches that the stabilizer pad may contact the borehole wall in order to stabilize the bit. However, the preferred examples given describe an annulus between the exterior of the stabilizer pad and wall of the borehole in order to avoid sticking; therefore, it is evident from these examples that constant contact with the borehole wall is not desired. Furthermore, this tool fails to address the fundamental cause of bit vibrations which is stored energy in the drill string.

Another means for controlling bit vibrations is found in U.S. Pat. No. 3,915,246, incorporated herein. In this patent a drill bit is disclosed having a drill body with a full gauge, upper stabilizer section and an intermediate taper section tapering to a reduced diameter from the stabilizer section. This disclosure teaches the use of cutting elements having different heights in order to assist the advance of the bit with a minimum of required thrust. It also teaches the use of the upper row of cutting elements to form the gauge of the borehole. A drawback of this design is that as the bit vibrates these aggressive gauge cutting elements tend to cut further into the formation, increasing the diameter of the borehole and contributing to bit instability instead of reducing it. Also as the rotating bit advances, these aggressive cutting elements will form spiral grooves in the sidewall of the borehole producing a thread like condition in the walls that may actually cause the bit to stick during tripping. Moreover, this bit also fails to solve the problem of frequent and rapid bit accelerations resulting from the release of stored energy in the drill string.

What is needed is a means for damping downhole tool vibrations that is economical, robust enough to withstand the native conditions of the borehole, and is not prone to mechanical failure due to the invasive presence of the abrasive drilling fluid. Furthermore, a tool is needed that can use the borehole, itself, to damp the vibrations incident to deep well drilling.

SUMMARY OF THE INVENTION

The vibration damper of this invention utilizes the borehole wall as a brake to control the torsional loading and unloading of downhole tools in order damp vibrations and achieve downhole tool stability. In many subterranean formations, the borehole wall may be used as a bearing surface. This invention seeks to use this property of the borehole wall as means to stabilize the downhole tool. The frictional vibration damper of this invention is intended to be used either on the downhole tool, itself, or in connection with other downhole tools. The vibration damper is adapted to receive wear resistant damper inserts that describe a circumference larger than the desired gauge of the borehole. These damper inserts are positioned on the downhole tools in such a fashion that they are constantly forced against the sidewalls of the borehole. They act like a frictional brake that maintains a constant torsional load on the downhole tools and controls torsional unloading in order to prevent violent accelerations of the downhole tools. The inserts may plastically deform the borehole wall by an indenting, brinelling, or crushing action as a means of damping radial and longitudinal vibrations incident to subterranean drilling. The damper may be tapered or the damper inserts may describe a progressively increasing circumference in order to maintain a constant force against the borehole wall during drilling. The working surface of the damping inserts is coated with a superhard material such as polycrystalline diamond or cubic boron nitride and is configured to have a rounded, non-aggressive working surface. These superhard materials assist in controlling the amount of friction and heat produced by the damper. This superhard coating is abrasion resistant and capable of withstanding the heat and pressure generated by the damping inserts. The damper may also consist of a means for cooling the damping inserts using the drilling fluid.

DETAILED DESCRIPTION OF THE INVENTION

The invention disclosed herein presents a damper for downhole tools that utilizes cooperation between the formation being drilled and the downhole tool in order to damp the tool's vibrations due to drill string flex and torsional loading and unloading incident to subterranean drilling.

A limitation that has dominated the design of downhole tools has been the desire to center the tool within the borehole in such a fashion that it does not rub on the sidewall, or at least to minimize contact with the sidewall, in order to avoid sticking the tool downhole. It has not been uncommon in the industry for drill bits, drill pipe, and other drilling tools to become stuck, or bind up against the wall of the borehole during drilling. This is especially true in directional, extended reach, and deviated borehole drilling applications where the drilling tools are actually drilling in a near horizontal, or horizontal, orientation, which causes them to ride upon the formation being drilled. The abrasive nature of the formation and the drilling fluid being used, the high friction properties of the exterior of the drilling tools, and the formations natural resistance to the drill bit combine and contribute to the propensity of downhole tools to get stuck. The damper of this invention presents a contravention to this traditional design limitation and presents a tool that is actually forced against the sidewalls of the borehole as a means for damping downhole tool vibrations. The applicants believe that clearance between the exterior of the downhole tool and the borehole wall allows the tool to accelerate and vibrate excessively with potential damage to the borehole, the drill bit, and other drilling components. This invention overcomes the prior art design limitations by using damper inserts having low friction, abrasion resistant, superhard surfaces that are forced against the walls of the borehole. by so doing, the damper inserts provide a constant torsional load on the downhole tools and rapid torsional unloading in order to damp the tool's vibrations. The damper inserts are progressively arrayed on the tool's exterior surface in such a way that they describe a circumference greater than desired gauge of the borehole. In this manner, the damper inserts are constantly forced against the borehole wall, damping violent vibrations, as the tool is rotated downward. A fundamental cause of damaging vibrations is the torsional unloading of the downhole tools, especially the drill bit. The damper tool of this invention functions as a frictional brake that prevents rapid unloading of the torsional load, thereby controlling, or even eliminating, potentially damaging accelerations, or vibrations, in the downhole tools.

Figure 1:
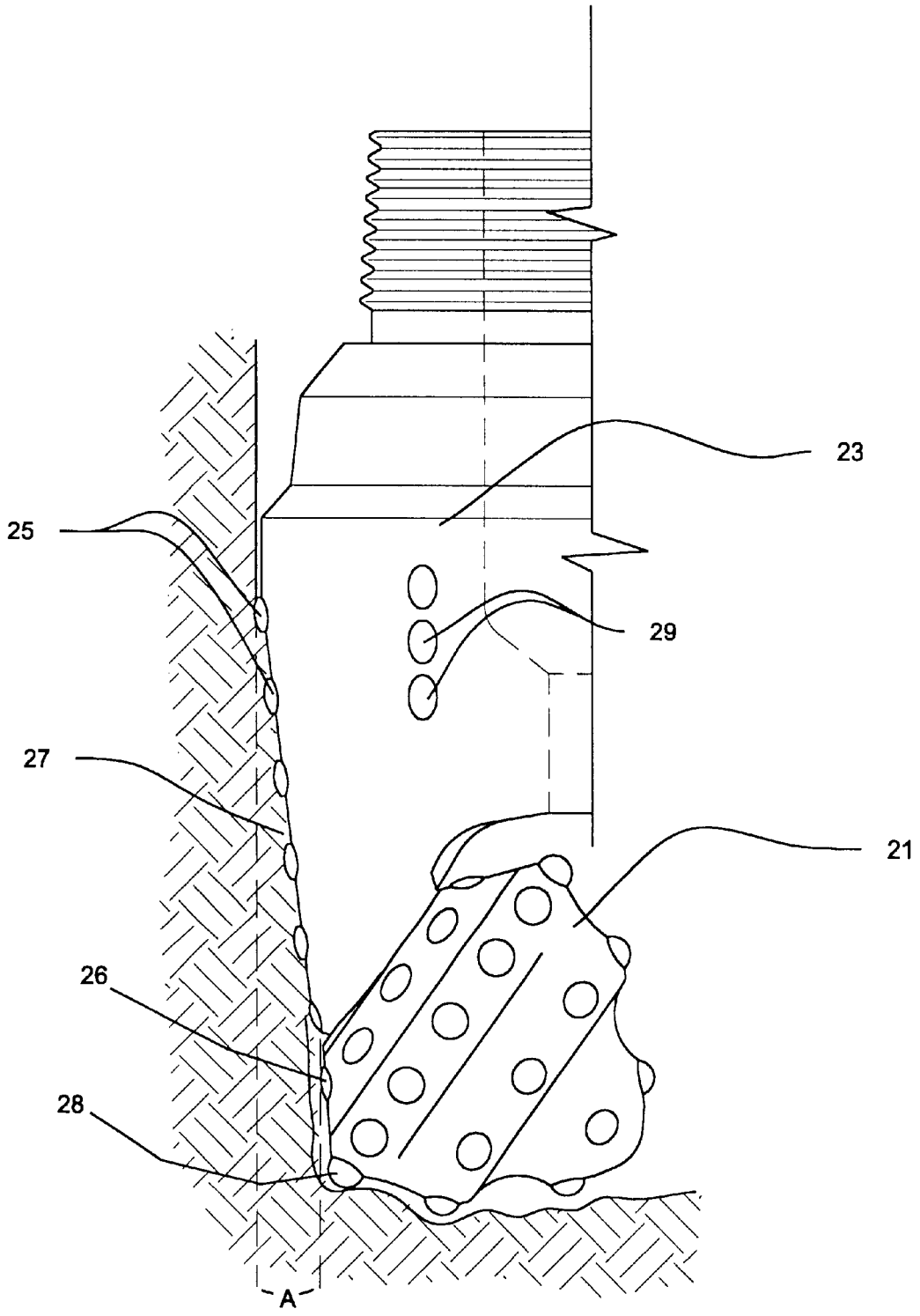
FIG. 1 is a representation of a roller cone bit depicting an application of the friction damping inserts of the present invention.

FIG. 1 depicts a representation of a roller cone drill bit consisting of a roller cone cutting structure 21 rotatably attached to the bit body 23. The roller cone is fitted with cutters 26 and 28 that cut into the formation 24 being drilled, forming the corner and desired gauge of the borehole. The bit body is adapted to receive damper inserts 25 and 29 arrayed about the bit body apart from the roller cone cutting structure. The adaptation may consist of preformed or machined receptacles into which the damper inserts are inserted and secured by either an interference fit or braze. The damper inserts may protrude as little as 0.005" to as much as 0.400" from the exterior surface of the bit body, depending upon the size of the tool and formation being drilled, and accordingly describe a circumference greater than the desired gauge of the borehole. The protruding surface of the damper inserts is rounded in order to ensure a non-aggressive indenting surface. The radial protrusion of the damper inserts serves to absorb the vibrations of the tool as well as to protect the bit body from wear during drilling. The superhard, low friction surface reduces the torque required to rotate the tool and the likelihood of sticking the tool downhole during tripping. In this view, the bit body is slightly tapered radially outward away from the bottom of the borehole, in order to constantly force the damper inserts against the sidewalls of the borehole 27, indenting, brinelling, and crushing the formation. In this manner they control torsional loading and unloading of the drill string and damp the vibrations of the tool. The taper "A" of the bit body may be exaggerated in this view for purposes of making clear the effects of the invention. Normally, the taper "A" would range from 0.50° to 15.0° as measured from the greatest circumference of the damper inserts 25 to the desired gauge of the borehole formed by the gauge cutter 26. Although not shown, the damper inserts may also protrude progressively from the tool body as a means of constantly forcing them against the wall of the borehole when a tool body having a straight, not tapered, configuration is desired, for example when retrofitting a prior art drill bit body or other tool with the damper inserts of this invention.

Figure 2:
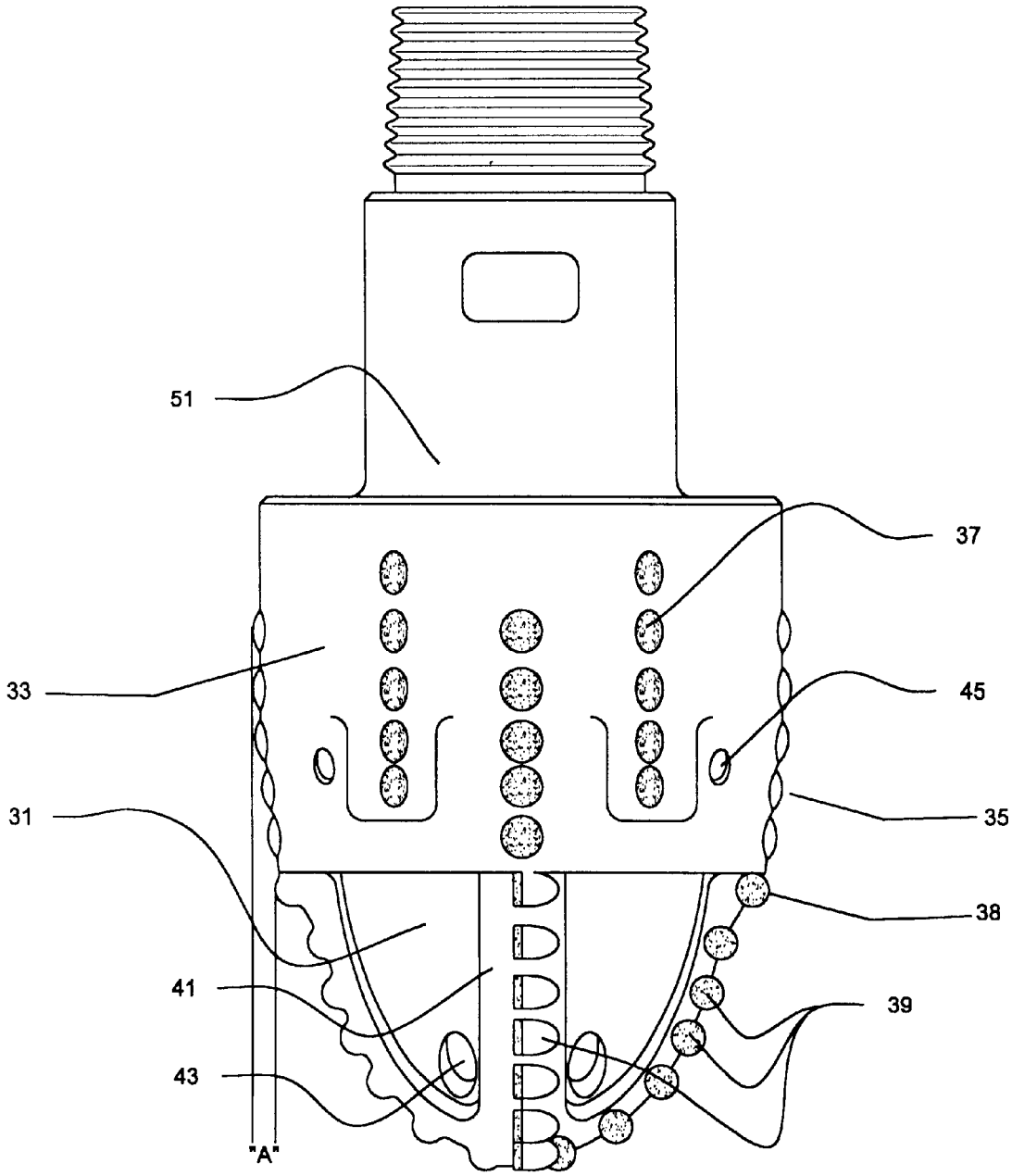
FIG. 2 is a representation of a shear bit depicting the application of the friction damping inserts of the present invention.

FIG. 2 is a representation of a shear bit having the damper inserts of this invention. The bit body 33 comprises a means for attachment 51 to a bottom hole assembly, not shown, consisting of a threaded pin section. The cutting structure 31 of the bit body comprises blades 41 that are adapted to receive cutting inserts 39. This adaptation may consist of preformed or machined receptacles into which the inserts are inserted and fixed in place either by an interference fit or by brazing. Cutting inserts 38 are used to form the desired gauge of the borehole as the bit drills down into the formation. Shear cutters 39 are coated with a superhard material such as polycrystalline diamond or cubic boron nitride and are intended to aggressively shear the rock as the bit is rotated either by a downhole mud motor or from the surface platform. Jets 43 are provided in the lower portion of the bit to allow drilling fluid that is forced through drill bit to exit in the vicinity of the cutting inserts in order to remove cuttings and cool the cutters as they penetrate the formation. Damper inserts 35 and 37 are arrayed about the bit body so as to describe a circumference greater than desired gauge of borehole as formed by inserts 38. The radially protruding working surface of the damper inserts is rounded in order to be less aggressive than the cutters of the cutting structure 31. Orifices 45 may be provided as a means of exhausting a portion of the drilling fluid in the vicinity of the damper inserts in order to clear away debris and as cooling medium for the inserts as they indent, brinell, and crush the formation and damp the vibrations of the drilling tool. The damper inserts may be arrayed in a helical pattern, not shown, around the bit body as a means of increasing the number of damper inserts, and, perhaps in some formations, for added vibration control. In this view, the working surfaces of the damper inserts 35 and 37 have a rounded configuration, which may serve to reduce the amount friction produced during drilling without compromising vibration damping. As in FIG. 1, the bit body 33 has a taper "A" measured from the greatest circumference described by the damper inserts to the circumference described by gauge insert 38. Normally this taper will range from between 0.50° to 15.0°, depending on the optimal use of the bit. The taper is useful to ensure that the damper inserts are constantly forced against the walls of the borehole as the bit penetrates the formation thereby controlling torsional unloading of the drill string and damping potentially damaging vibrations. In some bit applications, it may be desirable to progressively increase the protrusion of the damper inserts in order to ensure that they are constantly forced against the wall of the borehole.

Figure 3:
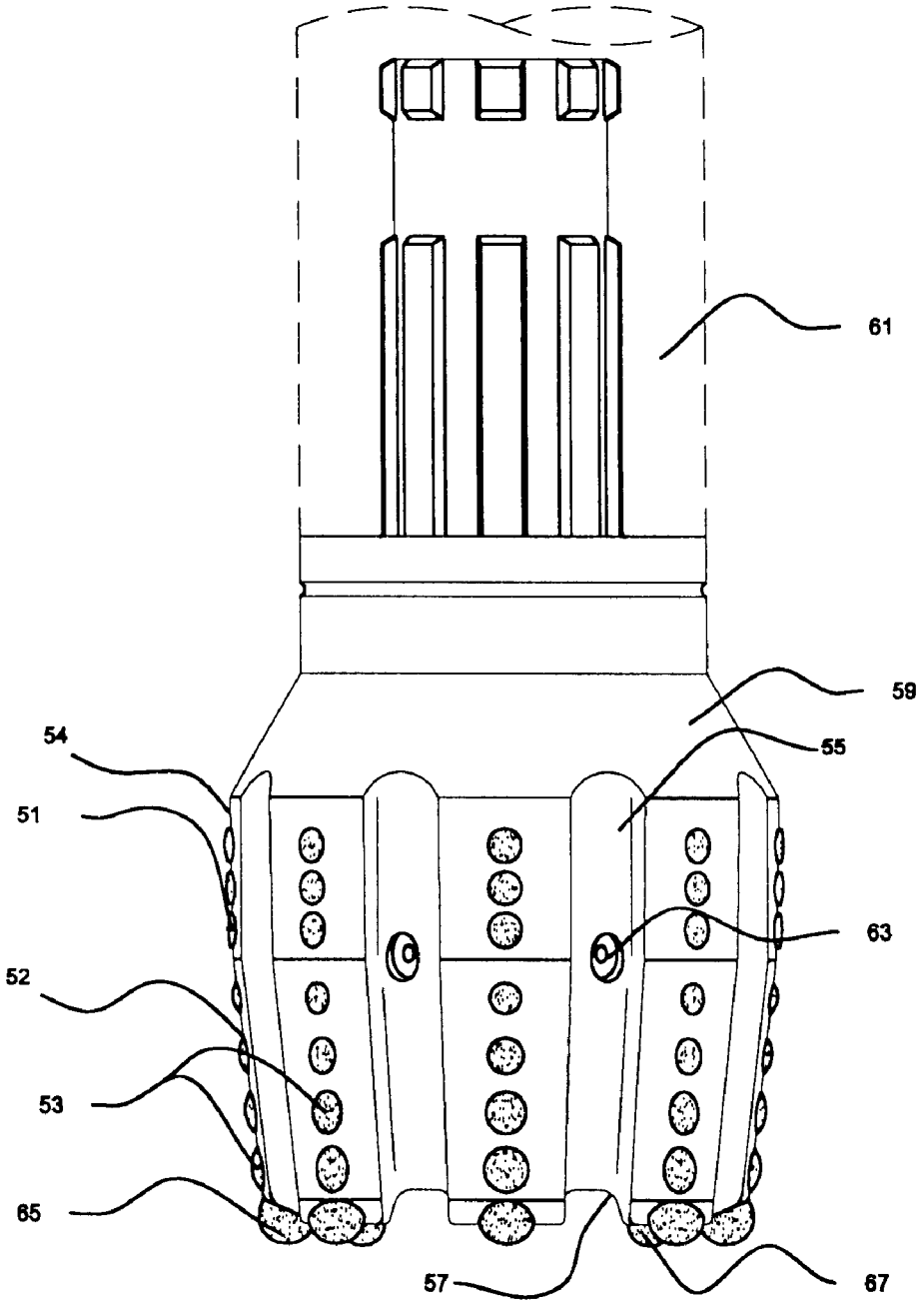
FIG. 3 is a representation of a percussion bit depicting the application of the friction damping mechanism of the present invention.

FIG. 3 is a representation of a percussion bit used in mining and drilling oil, gas, and geothermal wells. A percussion bit penetrates the formation being drilling by means of a percussive force transmitted from a percussive piston located above the bit to the cutting elements arrayed about the bottom of the bit. The bit is rotationally indexed between impacts and drilling fluid is used to wash away the cuttings so that fresh rock may be exposed and impacted with each cycle. Although a percussive bit drills by means of longitudinal vibrations, uncontrolled torsional loading and unloading of the drill string and other downhole tools causing excessive axial and radial vibrations are undesirable; therefore, a percussive bit may also benefit from the damping means disclosed herein. This bit comprises a bit body 59 and a means 61 for attaching the bit body to a drill string so that both rotation and percussive impacts may be transmitted from the drill string, mud motor, or percussive piston to the percussive inserts 65 and 67. The bit body also comprises slots 55 and nozzle 57, not shown, to promote the flow of drilling fluid around the bit and to assist in stabilizing the bit during drilling. Circulating drilling fluid is the means whereby cuttings are removed from the bottom of the borehole, and the fluid is also beneficial for cooling the bit components during drilling. Percussive cutting elements 65 are positioned around the periphery of the bottom of the bit and are used to form the gauge of the borehole. Damper inserts 51 and 53 are positioned about the exterior surface of the bit above the gauge row. Damper inserts are less aggressive than the percussive cutting elements. As depicted here, damper inserts 53 have a rounded working surface coated with a superhard material such as polycrystalline diamond or cubic boron nitride. These superhard materials are high heat tolerant, are impact and abrasion resistant, and have a low coefficient of friction in order to reduce the torque required to rotate the bit. Damper inserts 51 are located along the upper damper portion of the bit. Inserts 51 have a substantially rounded working surface that is also coated with superhard material. In operation, the damper inserts are constantly forced against the borehole wall by means of tapers 52 and 54. As shown here, tapers 52 and 54 combine with the radially protruding damper inserts to describe a progressively increasing circumference greater than the desired gauge of the borehole. Consequently, a constant force is applied to the borehole wall during which the damper inserts may actually indent, brinell, and crush the formation while controlling torsional loading and unloading of the drill string and drill bit, damping the vibrations of the drill bit. Although not shown in FIG. 3, the flanks of the bit may be parallel to the wall of the borehole. The damper inserts may then be fitted into the bit so that they radially protrude at progressively varying heights describing a circumference greater than the intended gauge of the borehole, as a means of applying constant force against the formation and damping vibrations. The protrusion should not exceed 0.400" and may be a little as 0.005" depending on the size and design of the bit and the composition of the formation being drilled. Orifices 63 may also be provided at various locations in the drilling tool as a means increasing the flow of drilling fluid around the damper inserts in order to promote the removal of debris as the inserts indent the walls of the borehole. Another benefit from the increased circulation of drilling fluid is the removal of the heat that is produced as the inserts rub against the formation damping unwanted vibrations.

Figure 4:
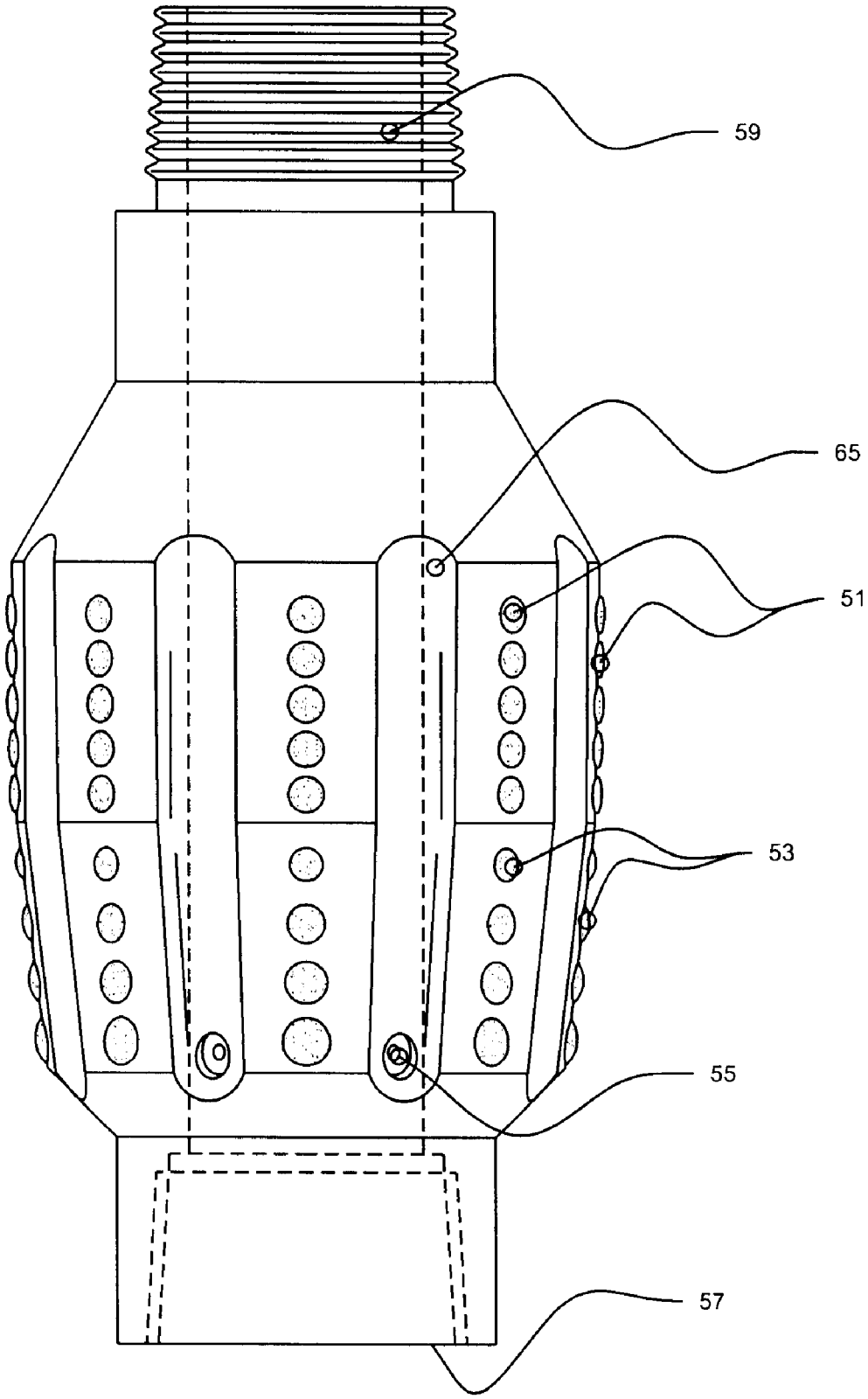
FIG. 4 is a representation of a down-hole tool damper of the present invention.

FIG. 4 is a representation of a drilling tool damper for use along the drill string. This damper tool may be used in cooperation with a variety of downhole tools; such as, drill pipes, drill pipe sub assemblies, bottom hole assemblies, drill bits, and mud motors and fluid driven hammer mechanisms. The damper tool has a threaded pin end 59 and a threaded box end 57 for deployment anywhere along the drill string and for connection to other drilling tools. Nozzles 55 provide a means for diverting drilling fluid that is being pumped through the bore of the drill string, or downhole tool, into the annulus between the drilling tool and the borehole wall. The drilling fluid may then be used to transport debris from around the damper inserts and as a means for removing the heat generated by the friction produced as the damper inserts rub against the walls of the borehole. Slots 65 also direct the flow of drilling fluid and promote drill tool stability. Damper inserts 53 present rounded working surfaces that are also coated with a superhard material. The damper inserts are arrayed in such a fashion that they describe a circumference greater than desired gauge of the well bore so that they are constantly being forced against the formation as they damp the vibrations of the tool.

Figure 5:
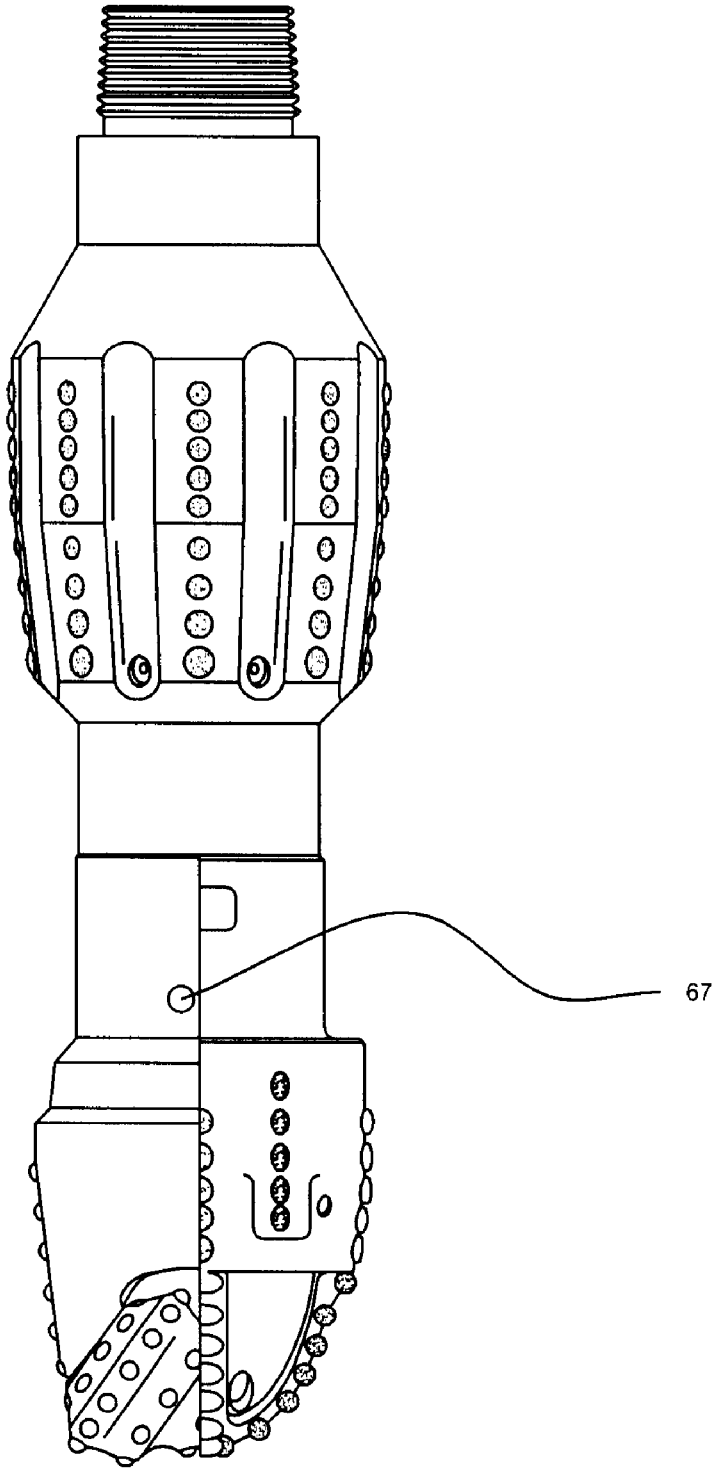
FIG. 5 is a representation depicting a composite roller cone shear bit having the down-hole damper inserts positioned above the bit.

FIG. 5 is a composite view of drilling tools of this invention. Composite roller cone/shear bit 67 is fitted with the damper inserts as depicted in FIGS. 1 and 2. Damper tool 65, FIG. 4, is depicted mounted above the drill bits. In practice, damper tool 65 may be located a other locations along the drill string as a means for controlling torsional loading and unloading of the downhole tools. The damper inserts protruding from the drill bits and damper tool describe a progressively increasing circumference that is greater than the desired gauge of the borehole. In this manner, a constant force is applied to the formation as the tools damp the vibrations incident to drilling.

FIG. 5 is a composite view of drilling tools of this invention. Composite roller cone/shear bit 67 is fitted with the damper inserts as depicted in FIGS. 1 and 2. Damper tool 65, FIG. 4, is depicted mounted above the drill bits. In practice, damper tool 69 may be located at other locations along the drill string as a means for controlling torsional loading and unloading of the downhole tools. The damper inserts protruding from the drill bits and damper tool describe a progressively increasing circumference that is greater than the desired gauge of the borehole. In this manner, a constant force is applied to the formation as the tools damp the vibrations incident to drilling.

Figure 6:
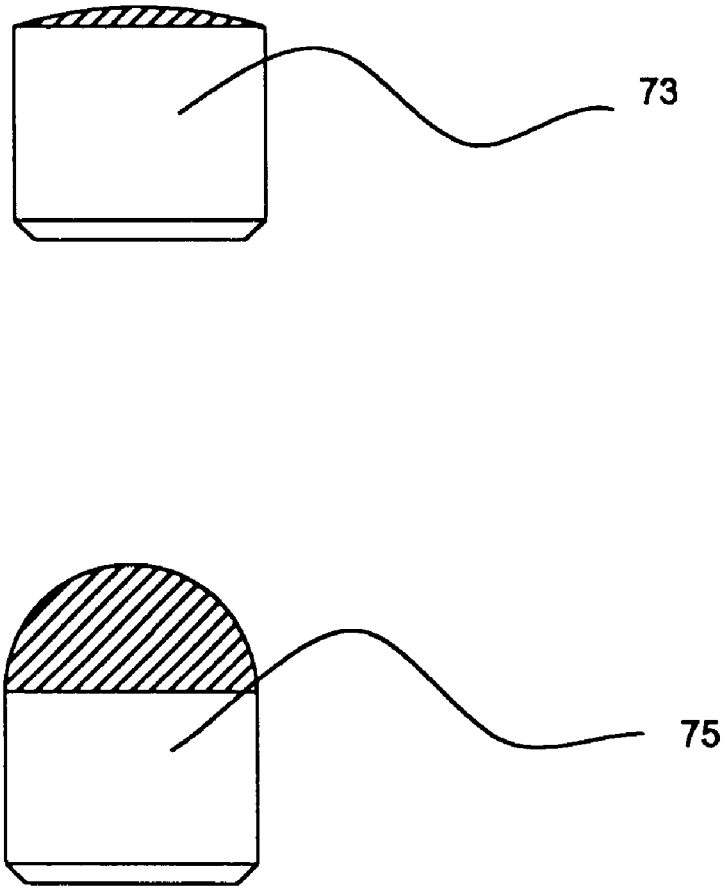
FIG. 6 is a configuration of friction damping inserts of the present invention.

FIG. 6 is a representation of damper inserts. A design feature of these inserts is that they are inefficient at penetrating the formation being drilled; consequently, as they are forced against the formation, they indent, brinell, or crush the rock in order to damp the vibrations of drilling tools. Typically, these damper inserts consist of a cylindrical stud of cemented metal carbide, such as tungsten carbide, bonded to a layer of superhard material such as polycrystalline diamond or cubic boron nitride at high pressures and high temperatures where the superhard crystals are crystallographically stable. These superhard materials are abrasion resistant, high heat tolerant, and have a low coefficient of friction. The properties of the superhard coating enable the damper inserts to withstand the abrasion and heat produced as they rub on the formation during drilling, while the low coefficient of friction reduces the amount of torque required to rotate the drilling tool. Damper inserts 73 have a substantially rounded working surface. The interfacial surface between the superhard coating and the hard metal stud may have either a planer or a nonplaner topography as a means of increasing the strength of the bond, as a means of promoting toughness and impact resistance, and as a means of relieving the stresses that may build up as a result of the bonding together of two materials whose coefficient of thermal expansion are close but not identical. Damper insert 75 has a domed working surface that is coated with a superhard material so that it exhibits all the properties of the inserts 73. An advantage of the domed configuration is that it also presents a surface that is inefficient at cutting the formation being drilled, so that it indents, brinells, and crushes the formation instead of cutting through it. In this manner the damping inserts are capable of producing the frictional damping force required to create a constant torsional load on the downhole tools and control rapid torsional unloading of the drill string as well as potentially damaging downhole tool vibrations.

What is claimed:

1. A frictional damper for a downhole tool, comprising:

a. a downhole drilling tool having a damper portion adapted to receive a plurality of damper inserts;

b. the damper inserts comprising of a hard metal body adapted for installation into the drilling tool and having a rounded working surface;

c. the rounded working surface of the damper inserts being bonded to a layer of superhard material at high pressure and high temperature; and d. the damper inserts being arrayed about the tool body so as to describe a circumference larger than the desired gauge of a borehole, so that their working surface is constantly forced against the walls of the borehole, producing frictional damping by plastically deforming the formation, and producing a constant torsional load on the downhole tools and preventing rapid torsional unloading of the downhole tools, and thereby absorbing the axial and radial vibrations of the downhole tool.

2. The frictional damper of claim 1 wherein the superhard materials are selected from the group consisting of diamond, polycrystalline diamond, and cubic boron nitride.

3. The frictional damper of claim 1 wherein the hard metal body of the damping inserts is selected from the group consisting of cemented metal carbides.

4. The frictional damper of claim 1 wherein the down hole drilling tools are selected from the group consisting of drill pipes, subs, drill collars, bottom hole assemblies, and drill bits.

5. The down hole drilling tools of claim 4 wherein the drill bits are selected from the group consisting of shear bits, roller bits, and percussion bits.

6. The frictional damper of claim 1 wherein the damper portion of the downhole tool that is adapted to receive damping inserts is tapered in a direction away from the drill bit.

7. The frictional damper of claim 1 where the radial protrusion of the damper inserts describe a circumference at least 0.010" greater than the desired gauge of the borehole.

8. The frictional damper of claim 1 wherein the damping inserts radially protrude at varying distances from the surface of the tool body.

9. The frictional damper of claim 1 wherein the damping inserts are arrayed in a spiral in the direction of the bit's rotation and directed away from the drill bit.

10. The frictional damper of claim 1 wherein the downhole tool consists of a means for cooling the damping inserts consisting of apertures and channels for directing the flow of the drilling fluid around the damping inserts.

* * * * *